United States Patent [19]

Swisher et al.

[11] Patent Number: 4,629,014

[45] Date of Patent: Dec. 16, 1986

[54] DERRICK

[75] Inventors: Roger C. Swisher, Madla; Jens O. Flobak, Stavanger; Bjørn Eilertsen, Sola; Nikolai Jakobsen, Gol; Jonny Gabrielsen, Sandnes, all of Norway

[73] Assignee: O.T.C. A/S, Sola, Norway

[21] Appl. No.: 691,009

[22] Filed: Jan. 14, 1985

[30] Foreign Application Priority Data

Feb. 24, 1984 [NO] Norway ..... 840705

[51] Int. Cl.[4] ..... F21B 15/02; F21B 15/00

[52] U.S. Cl. ..... 175/220; 173/141; 175/162

[58] Field of Search ..... 175/220, 202, 203, 27, 175/162, 5, 7; 173/141, 150, 144, 145, 152; 52/115; 185/19, 17, 6; 254/89, 95, 97

[56] References Cited

U.S. PATENT DOCUMENTS

| | | | |
|---|---|---|---|
| Re. 27,261 | 12/1971 | Bromell et al. . | |
| 2,276,016 | 3/1942 | Brantly | 175/220 X |
| 2,514,498 | 7/1950 | Kesler | 187/19 |
| 2,781,185 | 2/1957 | Robbins | 175/220 X |
| 2,807,441 | 9/1957 | Sewell . | |
| 2,869,826 | 1/1959 | Thornburg . | |
| 3,145,786 | 8/1964 | O'Neill et al. . | |
| 3,282,357 | 11/1966 | Bunn | 175/162 X |
| 3,365,008 | 1/1968 | Zimmerman et al. . | |
| 3,404,741 | 10/1968 | Gheorghe et al. . | |
| 3,465,607 | 9/1969 | Erdman . | |
| 3,695,363 | 10/1972 | Kelley | 173/152 X |
| 3,785,445 | 1/1974 | Scozzafava | 175/5 |
| 3,867,989 | 2/1975 | Hisey et al. . | |
| 3,937,301 | 2/1976 | Bertail | 187/19 |
| 3,949,818 | 4/1976 | Russell . | |
| 4,128,229 | 12/1978 | Ellison . | |

FOREIGN PATENT DOCUMENTS

| | | |
|---|---|---|
| 495278 | 8/1970 | Switzerland . |
| 1431759 | 4/1976 | United Kingdom . |
| 134646 | 7/1960 | U.S.S.R. . |
| 502109 | 4/1970 | U.S.S.R. . |

OTHER PUBLICATIONS

Transactions of the Institute of Marine Engineers, vol. 92, No. 42, Mar. 1983, pp. 1-11, Londres, GB; J. T. Hatleskog: "Drill String Compensators and Riser Tensioning Systems for Offshore Drilling", p. 7, FIG. 7.

*Primary Examiner*—Stephen J. Novosad
*Assistant Examiner*—David J. Bagnell
*Attorney, Agent, or Firm*—Schwartz, Jeffery, Schwaab, Mack, Blumenthal & Evans

[57] ABSTRACT

A derrick (1) for drilling and maintenance of oil and/or gas wells comprises a portal-shaped derrick structure installed on the drilling deck, consisting of an upper traverse (2) and two spaced-apart, substantially parallel, upright derrick components (3,4) which together define a free space (5), within which a hydraulic elevator (6) connected to a drilling machine (18) for the drill string (15) is adapted to travel along stationary, upright rack rails (10). The vertically movable elevator (6), in a manner known per se, is driven by means of hydraulic motors having gears (9) that engage with the rack rails (10).

4 Claims, 3 Drawing Figures

DERRICK

BACKGROUND OF THE INVENTION

1. Field of Invention

The present invention relates to a derrick for drilling and maintenance of oil and/or gas wells, especially intended for installation on a marine platform.

2. Related Art

The derrick structure used today for this purpose comprises an elevator drawwork driven by several direct current motors. The electrical power is transmitted via expensive and complicated, controlled rectifier systems. The elevator drawwork itself consists of several expensive and heavy components. A powerful, chain-driven winch is used which obtains power via large transmission gears, and the winch drives a drum that hoists the drilling line. The drilling line passes over a crown block and through a traveling block before it is fastened to a so-called "dead anchor". The drilling line must be replaced regularly. All of the equipment used today is very expensive. The equipment is also exceedingly heavy and this requires that the derrick itself be dimensioned accordingly, so that the derrick is tall, massive, heavy and expensive. Today's equipment is not adapted for accommodating equipment for cleaning the production pipes. Both the costs and the risks involved when performing this cleaning operation are very high. The only available equipment is extremely expensive, time-consuming to assemble and use, and unsatisfactory from a safety point of view. Moreover, it requires a huge power source. The power lost through the chain drives and all the blocks over which the drilling line must pass corresponds to almost half of the total power consumption. On floating rigs, heave compensators (assemblies to compensate for vertical movements due to wave surge) must be used during the drilling operations and when installing a blow-out preventer in the well head. A heave compensator today costs about NOK 10 million. Another drawback of the traditional elevator drawwork is its very high noise level.

Swiss Pat. No. 495,278 generally discloses a compartment-type elevator which carries hydraulic motors provided with gears that engage with vertical racks and drive the elevator along the racks.

U.S. Pat. No. 2,514,498 discloses an elevator for use in mine shafts utilizing, inter alia, stationary, vertical racks that mesh with gears driven from the elevator's load-bearing member.

British Pat. No. 1,431,759 describes a hoist for lifting a load from a reference point under conditions in which the reference point and the hoisting apparatus may move vertically in relation to each other, as might be the case when a heavy load is being hoisted from a pitching ship deck at sea. This specification suggests the use of a heave compensator to compensate for wave surge.

OBJECTS AND SUMMARY OF THE INVENTION

The object of the present invention is to alleviate the drawbacks of prior art derrick constructions and their associated equipment. The aim of the invention is to achieve substantial reductions in weight, work and costs, in addition to a significant reduction of the noise level compared to known derrick constructions. A particular aim has been to eliminate the use of a drilling line entirely, thus saving the time and work required every time the drilling line has to be replaced.

In accordance with the invention, these objects are obtained by providing a derrick for drilling and maintenance of oil and/or gas wells, especially intended for installation on marine platforms. The derrick includes a drilling machine for a drill string, the drilling machine being connected to a vertically movble elevator which in a manner known per se is driven by means of motors, preferably hydraulic motors, for moving the elevator and thereby the drilling machine in a vertical direction. The invention specifically has a portal-like derrick structure formed by an upper traverse and two spaced-apart, substantially parallel, upright derrick components which together define a space within which the preferably hydraulic elevator is adapted to travel along stationary, upright rack rails.

The derrick comprises, as known per se, a drilling machine for the drill string. The drilling machine is connected to a vertically movable elevator, which as known per se is driven by means of hydraulic motors having gears that engage with stationary, upright racks for moving the elevator and connected drilling machine vertically along the racks. The elevator is adapted to travel along said racks, which are arranged at the margins of a space defined by two spaced-apart, substantially parallel, upright derrick components. These derrick components together with an upper traverse which connects the derrick components form a gantry-like derrick construction. The portal-shaped derrick construction, in combination with the known per se elevator construction with its associated rack rails, provides a large number of advantages in drilling and similar operations on board a drilling rig.

The combination derrick/elevator makes it possible to construct a lower, smaller, lighter-weight and simpler derrick having the same capacity as a traditional tall, heavy derrick. The derrick of the invention merely requires support beams for the guide rails along which the hydraulic elevator travels. This reduces both costs and weight. It is not necessary to install complicated, expensive, controlled rectifier systems, and the new construction requires only about half the power that conventional elevator drawworks require. This results in substantial savings, both in initial investment and in maintenance and operating costs. The combined derrick/elevator of the invention is easily adaptable for accommodating equipment for making the job of cleaning the production pipes simpler, and even more important, safer. This saves costs in connection with the pipe cleaning process. The derrick/elevator combination of the invention can also be easily adapted for carrying new equipment which will make "retracting" unnecessary—i.e., withdrawal of the elevator/traveling block. The use of a hydraulic elevator will substantially reduce the noise on the drilling rig. The combination derrick-/elevator of the invention makes it unnecessary to install a heave compensator for the drill string, which represents a substantial reduction of investment costs. The combined derrick/elevator can easily be installed on existing drilling platforms.

Hydraulic motors are preferably used according to the invention, but to reduce costs even further there is nothing in principle to prevent the utilization of electric motors instead of hydraulic motors, which could then be powered by the existing electrical power system on the rig.

The elevator is driven via transmission gears along two rails having teeth on both sides. At a gear ratio of about 1:50 and using, say, eight gear wheels in the two derrick components, the power consumption will be only about half of that required on prior art structures. Moreover, the drilling line can be eliminated, which represents a significant weight reduction. The traveling block alone must be very heavy so that it can accelerate as quickly as possible during free fall. The "dead time" for replacing the drilling line is of course also eliminated. Since the derrick of the invention requires no crown block, it does not need a "gin pool" (an extra top member on conventional derricks into which the crown block is hoisted). This also helps reduce the height, weight and price of the derrick.

Using the hydraulic elevator, the load can be let down along the rack rails, which means that the derrick dimensions can be reduced to the minimum that is adequate for bearing the loads Since the elevator travels up and down on the rack rails, which can carry loads in both directions, it is possible to install new equipment for cleaning the production pipes. This makes the cleaning operation simpler, quicker, safer and cheaper.

The elevator requires no mechanical braking system other than an emergency brake system, and this reduces the noise level substantially. Since the hydraulic elevator itself acts as a compensator, and has both a greater stroke length and capacity than the conventional assemblies, the cost of the heave compensator on floating rigs is reduced. Because the weight of the derrick is reduced substantially, the center of gravity of the structure will be much lower than on known floating rigs, which is an important advantage. Retracting is simplified by a recess provided on the elevator.

By arranging the drilling machine on the transverse support beam above the elevator, one obtains the advantage that the torque from the drill string is transferred to the guide edges along the rack rails. The transverse support beam or traverse on which the drilling machine rests above the elevator, can in a manner known per se be provided with a heave compensator.

BRIEF DESCRIPTION OF THE DRAWINGS

Examples of the invention's construction and use are shown in the accompanying drawings, wherein.

DETAILED DESCRIPTION OF THE INVENTION

Figure 3:
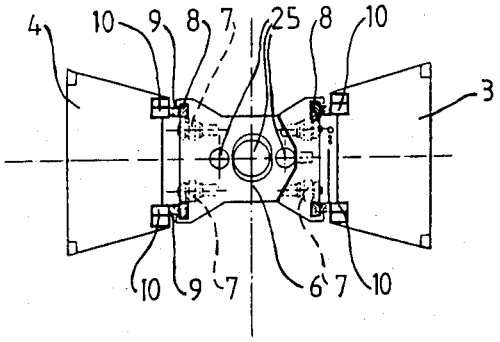
FIG. 3 is a horizontal cross section along the line III—III in FIG. 2.

The derrick structure, generally designated by reference numeral 1, is a portal-shaped construction. The derrick 1 comprises an upper, fixed traverse 2 and two spaced-apart, substantially parallel, upright derrick components 3 and 4 which together define a space 5 for accommodating a vertically movable elevator 6, as seen in more detail in FIG. 3.

The hydraulic elevator 6, as known per se, is adapted to be driven by a plurality—in the illustrated example, four—of hydraulic motors 7 mountd on said elevator. Each motor drives a respective transmission gear 8, which in turn drives a respective gear 9. The gears 9 hoist or lower the hydraulic elevator 6, because they are engaged with and roll along vertical, stationary rack rails 10 mounted on guide rails for the gears 9 on the derrick 1. The hydraulic elevator 6 is braked by blocking the hydraulic motors 7. It can also be braked by activating brake discs (not shown) which are adapted to be activated automatically if the hydraulic pressure disappears. The shafts for the gears 8 and 9 are mounted with roller bearings and are immersed in a sealed oil bath.

The elevator 6, in the region of the drill string 15, can be formed with a recess which enables drilling equipment to be installed and also ensures free passage of the elevator 6 along the drill string 15. Guide wheels (not shown) can also be provided, intended to engage with the rack rails 10 for ensuring horizontal control over the elevator. Guide rails (also not shown) can also be provided, formed for holding the gears 9 in position and in engagement with the racks 10.

Figure 1:
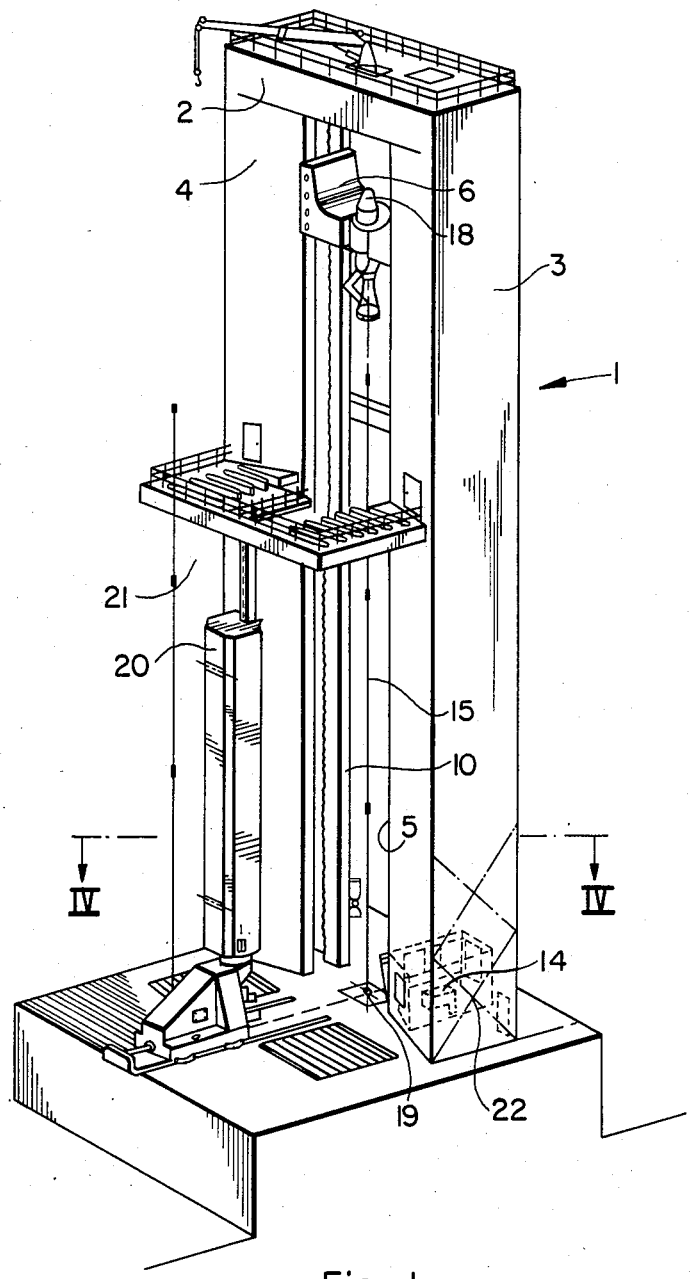
FIG. 1 shows a first embodiment of a derrick structure and associated equipment installed on a marine platform, in perspective view.

In FIG. 1, the elevator 6 is directly connected to a hydraulic drilling machine 18 for the drill string 15.

Figure 2:
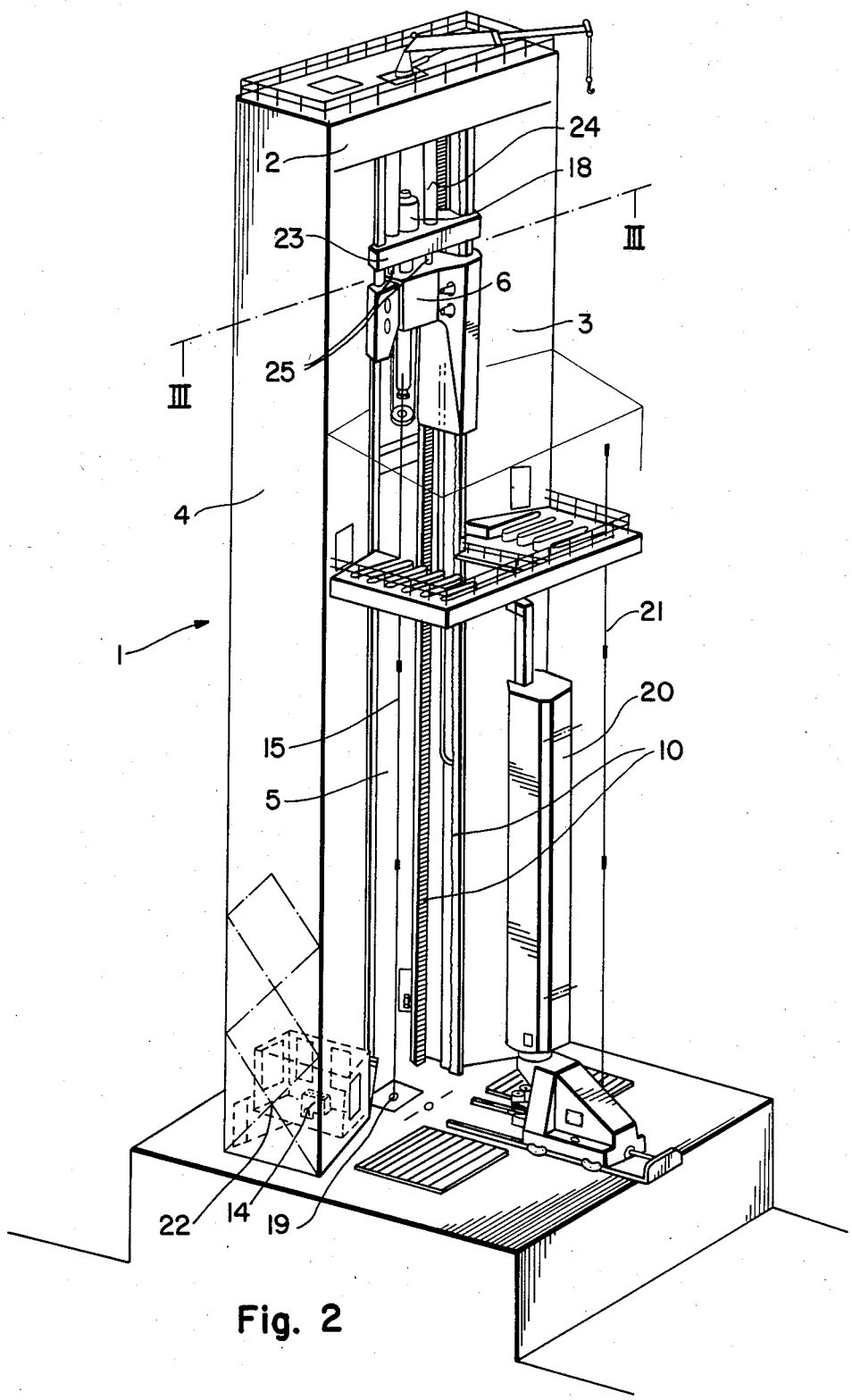
FIG. 2 shows a somewhat modified second embodiment, similarly drawn in perspective but on a somewhat larger scale and seen from a different angle.

In FIG. 2, the drilling machine 18 is mounted on a freestanding, transverse support beam 23 above the elevator 6. The drilling machine 18 is fastened to the cross-beam or traverse 23 which rests on the elevator 6. When no drilling is being done, the traverse 23 with the drilling machine 18 can be locked in an upper "parked" position. An advantage of using a traverse, whose ends extend to the guide edges of the rack rails 10, is that the torque from the drill string will be transferred via the traverse 23 to said guide edges. The cross-beam or traverse 23, as known per se, is provided with a heave compensator 24. Connecting and guide means 25 are provided between the drilling machine and the elevator.

A rathole 19 is also provided, as well as a conventional pipe-handling apparatus 20 for handling and storing stands of drill pipe 21.

A control room 22 is built into the base of one derrick component (3 in FIG. 1, or 4 in FIG. 2). The control system comprises weighing cells placed in the elevator 6, which provide the necessary impulses to cause the elevator 6 to move within the derrick in accordance with the wave motion and optionally automatic drilling.

We claim:

1. A derrick for drilling and maintenance of oil and/or gas wells, especially intended for installation on marine platforms, comprising:
   (a) a drilling machine (18) for a drilling string (15);
   (b) a vertically movable hydraulic elevator (6);
   (c) the drilling machine (18) being connected to the vertically movable elevator (6) driven by means of a plurality of hydraulic motors (7) mounted on said elevator for moving the elevator (6) and thereby the drilling machine (18) in a vertical direction;
   (d) a portal-like derrick structure (1) formed by an upper traverse (2) and two spaced-apart, substantially parallel, upright derrick components (3, 4) which together define a space within which the elevator (6) is adapted to travel along a plurality of stationary, upright rack rails (10), the rails being arranged in the derrick (1) and on the derrick components (3, 4);
   (e) each motor (7) directly driving gear means engaging a respective rail (10).

2. A derrick according to claim 1, characterized in that the elevator (6) is formed with a recess which permits free passage of the elevator (6) along the drill string (15).

3. A derrick according to claim 1, characterized in that the drilling machine (18) is disposed on a transverse support beam (23) above the elevator (6), said support beam or traverse (23) extending to guide edges of the rack rails (10), such that the torque from the drill string will be transferred via the traverse (23) to said guide edges.

4. A derrick according to claim 3, characterized in that the traverse (23), in a manner known per se, is provided with a heave compensator (24).

* * * * *